US007145318B1

(12) United States Patent
Chan et al.

(10) Patent No.: US 7,145,318 B1
(45) Date of Patent: Dec. 5, 2006

(54) NEGATIVE VOLTAGE REGULATOR

(75) Inventors: Johnny Chan, Fremont, CA (US); Tin Wai Wong, Fremont, CA (US); Ken Kun Ye, Femont, CA (US)

(73) Assignee: Atmel Corporation, San Jose, CA (US)

( * ) Notice: Subject to any disclaimer, the term of this patent is extended or adjusted under 35 U.S.C. 154(b) by 0 days.

(21) Appl. No.: 11/284,779

(22) Filed: Nov. 21, 2005

(51) Int. Cl.
*G05F 3/16* (2006.01)
*G05F 1/40* (2006.01)

(52) U.S. Cl. ..... 323/316; 323/280; 327/539

(58) Field of Classification Search ..... 323/312–317, 323/273, 274, 275, 280, 281; 327/535, 536, 327/539, 540
See application file for complete search history.

(56) References Cited

U.S. PATENT DOCUMENTS 5,686,821 A * 11/1997 Brokaw ..... 323/273
6,040,736 A * 3/2000 Milanesi et al. ..... 327/540
7,023,262 B1 * 4/2006 Sim et al. ..... 323/313

OTHER PUBLICATIONS

Giovanni Campardo et al., "40-mm2 3-V-Only 50-MHz 64-Mb 2-b/cell CHE NOR Flash Memory," IEEE Journal of Solid-State Circuits, vol. 35, No. 11, pp. 1655-1666, Nov. 2000.

* cited by examiner

*Primary Examiner*—Jessica Han
(74) *Attorney, Agent, or Firm*—Sierra Patent Group, Ltd.

(57) ABSTRACT

A first voltage divider includes a first resistor having a first resistance coupled to a positive voltage reference in series with a second resistor having a second resistance and coupled to ground. A second voltage divider includes a third resistor having the first resistance coupled to the positive voltage potential in series with a fourth resistor having the second resistance, and a fifth resistor having a third resistance and coupled to a negative voltage. A comparator has an inverting input coupled to the junction of the first and second resistors and a non-inverting input coupled to the junction of the third and fourth resistors. The first and third resistors are equal and the second and fourth resistors are equal. The fifth resistor has a value chosen to drop a voltage equal to the target voltage to be regulated when the voltage regulator output is equal to that target voltage.

11 Claims, 3 Drawing Sheets

NEGATIVE VOLTAGE REGULATOR

BACKGROUND OF THE INVENTION

1. Field of the Invention

The present invention relates to integrated circuits and to voltage regulators disposed on integrated circuits. More particularly, the present invention relates to negative voltage regulators for integrated circuits and negative voltage regulators having trimmable settings.

2. The Prior Art

Existing voltage regulator circuits often include a comparator having a non-inverting input coupled to a voltage reference source and an inverting input coupled to a voltage divider having one end coupled to a positive voltage potential and another end coupled to a negative voltage potential. Such a portion of a voltage regulator circuit is shown in FIG. 1, in which comparator 10 has its non-inverting input coupled to a reference voltage $V_{REF}$ and its inverting input coupled to a series resistor network including a first resistor 12 and a second resistor 14 connected between $V_{CC}$ and a negative potential $V_{NEG}$. The connection to the inverting input of comparator 10 is made at the common terminals of resistors 12 and 14. The output of comparator 10 may be used in known ways to control the output voltage level of a negative-voltage charge pump.

In any given individual circuit such as the one depicted in FIG. 1, the voltage divider formed from resistors 12 and 14 may be "off" due to process variations and temperature, thus giving rise to errors in output voltage. In addition, the voltages presented to the inverting and non-inverting inputs of the amplifier in the circuit of FIG. 1 have no direct relationships to one another, thus introducing another potential source of output voltage error in a voltage regulator circuit employing such circuits.

BRIEF DESCRIPTION OF THE INVENTION

According to one aspect of the present invention, a stable reference voltage provides a voltage potential. A first voltage divider includes a first resistor having a first resistance and coupled to a positive voltage reference potential in series with a second resistor having a second resistance and coupled to ground. A second voltage divider includes a first resistor having the first resistance and coupled to a positive voltage reference potential in series with a second resistor having the second resistance, the second resistor in series with a third resistor having a third resistance and coupled to a negative voltage potential. A comparator has an inverting input coupled to the first voltage divider between the first and second resistors and a non-inverting input coupled to the second voltage divider between the second and third resistors. The output of the comparator is used to control the output voltage of the regulator. The values of the first resistors in both voltage dividers are equal. The values of the second resistors in both voltage dividers are equal. The value of the third resistor in the second voltage divider is chosen such that it will drop a voltage equal in magnitude to the target voltage to be regulated when the voltage regulator output is equal to that target voltage.

According to a second aspect of the present invention, the voltage dividers may include electronically trimmable resistors. For example, the third resistor in the second voltage divider may be electronically trimmable. In another example, the first resistor of the first voltage divider and the first resistor of the second voltage divider are both electronically trimmable. In another example, the second resistor of the first voltage divider and the second resistor of the second voltage divider are both electronically trimmable. In yet another example, the first resistor of the first voltage divider and the first resistor of the second voltage divider are both electronically trimmable, and the second resistor of the first voltage divider and the second resistor of the second voltage divider are both electronically trimmable.

BRIEF DESCRIPTION OF THE DRAWING FIGURES

DETAILED DESCRIPTION OF THE INVENTION

Persons of ordinary skill in the art will realize that the following description of the present invention is illustrative only and not in any way limiting. Other embodiments of the invention will readily suggest themselves to such skilled persons.

Figure 1:
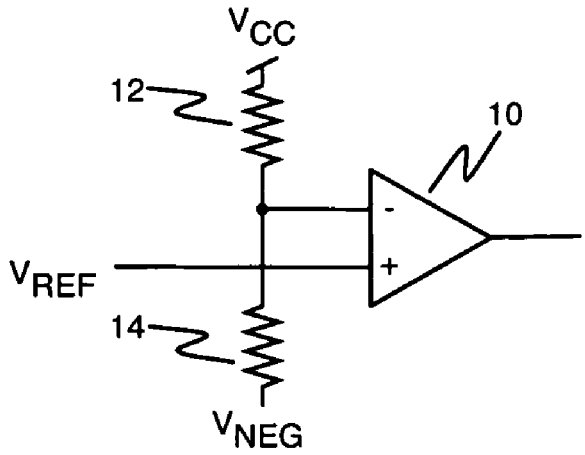
FIGURE 1 (PRIOR ART)
FIG. 1 is a schematic diagram of a typical prior-art control circuit for a negative voltage regulator.
Figure 2:
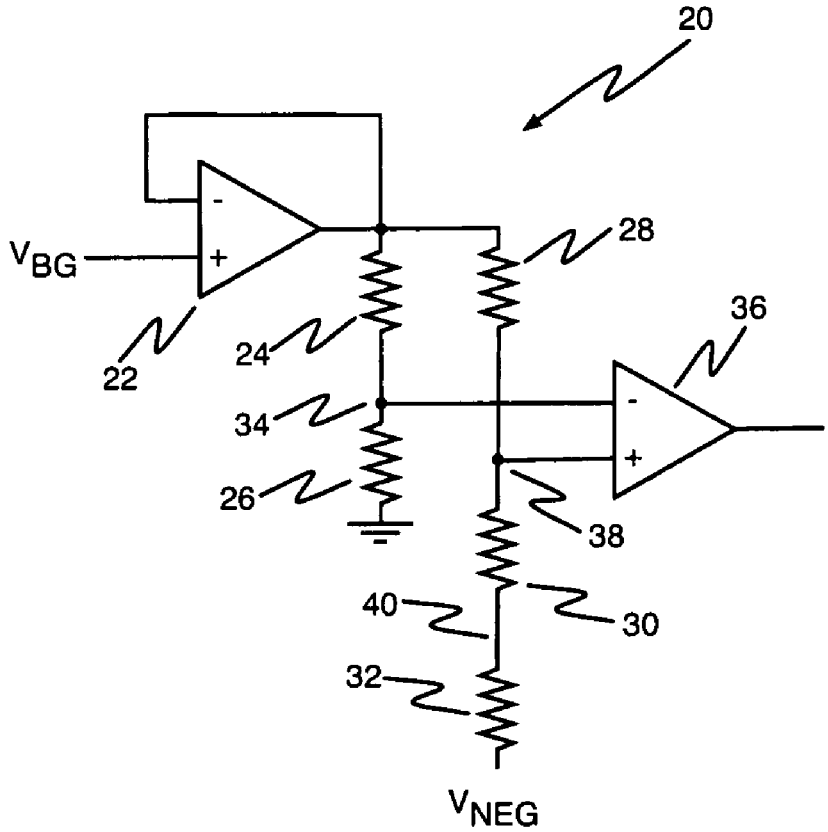
FIG. 2 is a schematic diagram of a control circuit for a negative voltage regulator according to one aspect of the present invention.

Referring now to FIG. 2, a schematic diagram shows a control circuit 20 for a negative voltage regulator according to one aspect of the present invention. Control circuit 20 includes an amplifier 22 configured as a follower, having as its input a stable reference voltage such as the output of a bandgap reference shown as the potential $V_{BG}$. If a bandgap reference is employed, the reference voltage will be fairly stable as will be appreciated by persons of ordinary skill in the art.

The output of amplifier 22 drives two voltage dividers. The first voltage divider is formed from resistors 24 and 26 and is referenced to ground potential. The second voltage divider is formed from resistors 28, 30, and 32 and is referenced to the negative voltage (shown in FIG. 2 as "$V_{NEG}$") to be regulated. In typical applications, the potential $V_{NEG}$ is generated by a negative charge pump circuit (not shown) as is known in the art.

The node 34, comprising the common terminals of resistors 24 and 26 in the first voltage divider, is coupled to the inverting input of a comparator 36. The node 38, comprising the common terminals of resistors 28 and 30 in the second voltage divider, is coupled to the inverting input of a comparator 36.

According to the present invention, the resistors 24 and 28 have the same value of resistance $R_A$, and the resistors 26 and 30 have the same value $R_B$. The resistor 32 has the value of resistance $R_C$. In addition, all of the resistors 24, 26, 28, 30, and 32 are formed physically adjacent to one another in the integrated circuit in order to track closely with one another as a function of temperature.

The voltage $V_{34}$ at node 34 can be expressed as:

$$V_{34}=V_{BG}(R_B/(R_A+R_B))$$

and the voltage $V_{38}$ at node 38 can be expressed as:

$$V_{38}=(V_{BG}-V_{NEG})((R_B+R_C)/(R_A+R_B+R_C))$$

When the voltage $V_{NEG}$ is zero prior to startup of the negative-voltage charge pump, this expression can be rewritten as:

$$V_{38}=(V_{BG}-0)((R_B+R_C)/(R_A+R_B+R_C)).$$

According to the present invention, when the voltage $V_{NEG}$ reaches its target value at the regulation point, the comparator 36 is at its trip point where $V_{34}=V_{38}$ since the value $R_C$ of resistor 32 is chosen such that the voltage will be zero at second voltage divider node 40, comprising the common terminals of resistors 30 and 32 when the voltage $V_{NEG}$ reaches its target value. In this case, the expression for the voltage $V_{38}$ at node 38 can be rewritten as:

$$V_{38}=V_{BG}(R_B/(R_A+R_B))$$

as is the case for the voltage $V_{34}$, since now $V_{34}=V_{38}$.

As an example, if $V_{BG}$ is set at +1.25V, and the target value for $V_{NEG}$ is set at −10V, the values of $R_A$, $R_B$, and $R_C$ may be chosen to be 50 k ohms, 59.625 k ohms, and 877 k ohms, respectively. At startup, when the voltage $V_{NEG}$ is at zero volts, the voltage $V_{34}$ at node 34 will be 0.6799 volts, the voltage $V_{38}$ at node 38 will be 0.949 volts, and the voltage $V_{40}$ at node 40 will be 0.88 volts.

As the charge pump begins to operate, voltage $V_{NEG}$ starts to drop below zero volts. When $V_{NEG}$ reaches its target value of −10V, the voltage $V_{34}$ at node 34 in this example will be 0.6799 volts, the voltage $V_{38}$ at node 38 will also be 0.6799 volts, and the voltage $V_{40}$ at node 40 will be 0 volts. At this point, the voltages across resistors 24 and 26 will be the same as the voltages across resistors 28 and 30, since the bottom terminals of resistors 26 and 30 are both at ground potential. As $V_{NEG}$ becomes increasingly negative past this point, comparator 36 will trip.

Figure 3A:
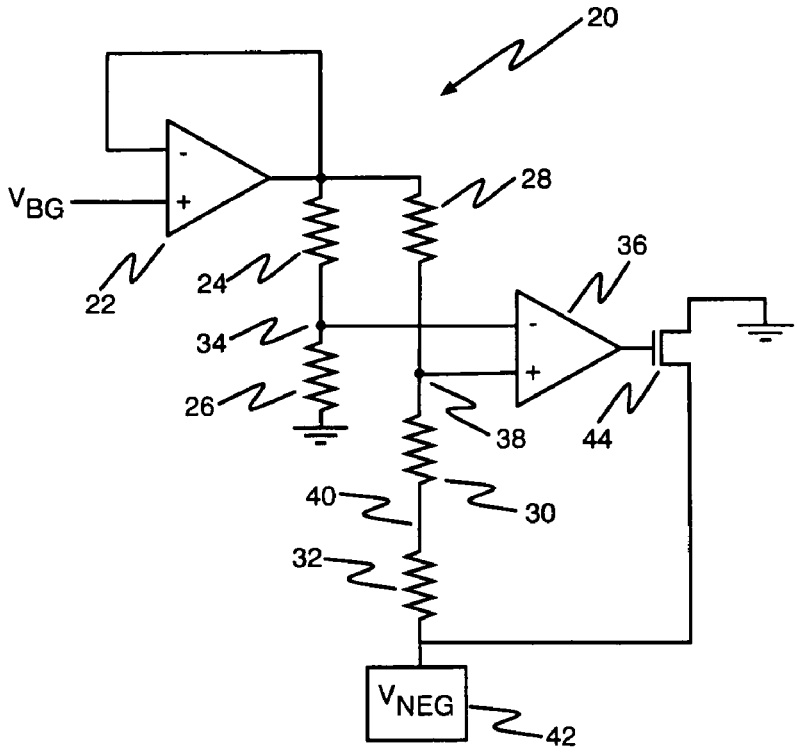
FIGS. 3A and 3B show illustrative alternate ways to control the output voltage of the negative voltage regulator according to the present invention.
Figure 3B:
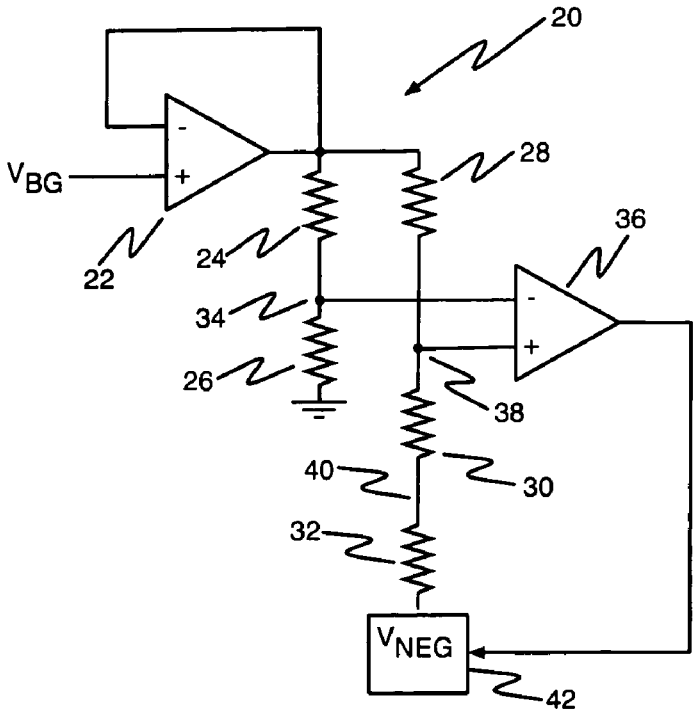

The output of comparator 36 may thus be used to control the voltage $V_{NEG}$, as shown in FIGS. 3A and 3B. Elements of FIGS. 3A and 3B that appear in FIG. 2 will be referred to by the same reference numerals used for those elements in FIG. 2. In the embodiment shown in FIG. 3A, the output of the negative charge pump 42 at the bottom end of resistor 32 is controlled by n-channel MOS transistor 44, whose gate is coupled to the output of comparator 36. As long as the voltage output of negative charge pump 42 is below the target voltage of −10 volts, n-channel MOS transistor 44 remains off. When the voltage output of negative charge pump 42 rises above the target voltage of −10 volts, n-channel MOS transistor 44 is turned on and regulates the voltage output of negative charge pump 42 because of the feedback circuit.

Referring now to FIG. 3B, negative charge pump 42 at the bottom end of resistor 32 is controlled by the output of comparator 36. As long as the voltage output of negative charge pump 42 is above the target voltage of −10 volts, the charge pump 36 is enabled. When the voltage output of negative charge pump 42 drops below the target voltage of −10 volts, comparator 36 trips and turns off charge pump 42, thus regulating the output of negative charge pump 42.

Figure 4:
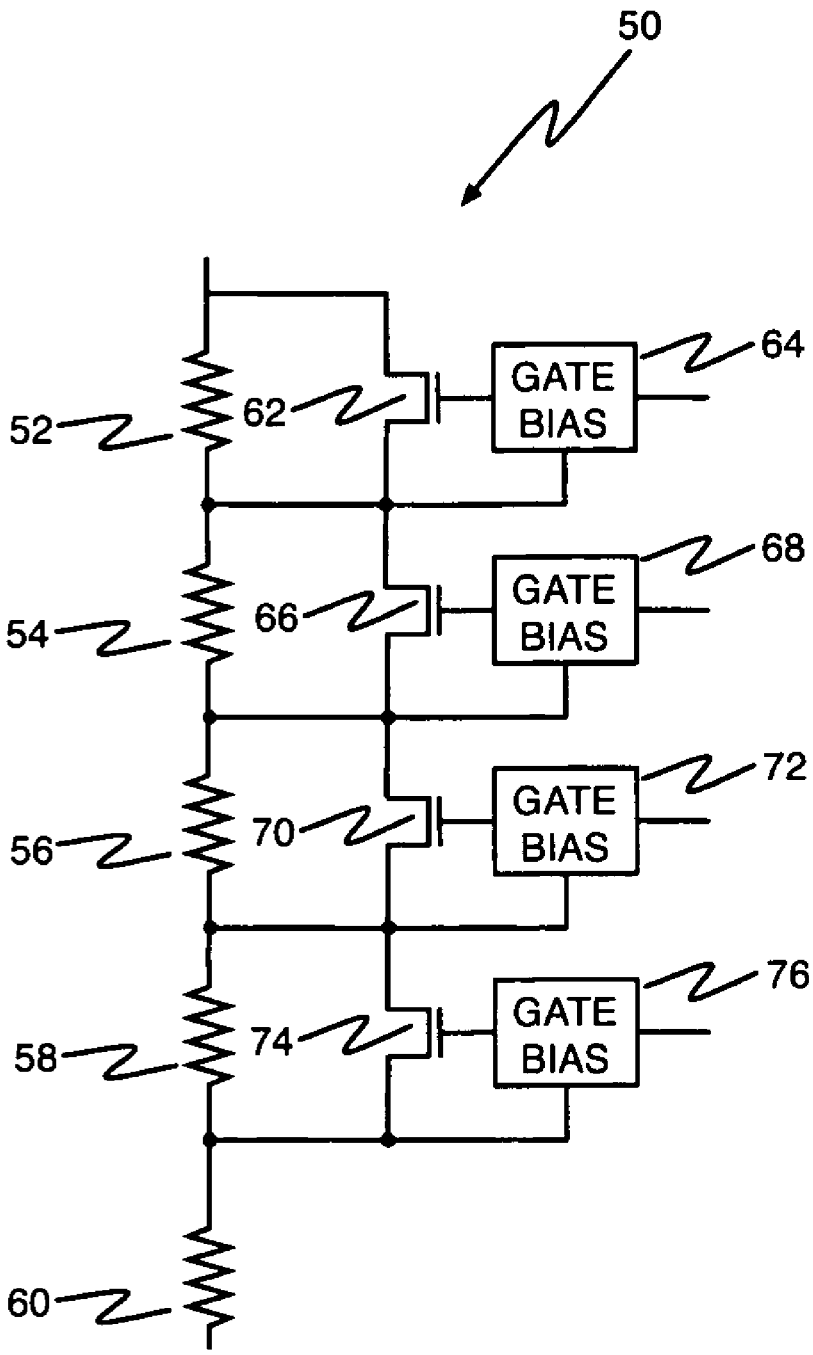
FIG. 4 is a schematic diagram of a trimmable resistor arrangement suitable for use in a negative voltage regulator according to the present invention.

Referring now to FIG. 4, a schematic diagram shows an illustrative trimmable resistor arrangement suitable for use in a control circuit for a negative voltage regulator according to the present invention. Trimmable resistor 50 includes a plurality of resistors connected in series. As shown in FIG. 4, five resistors 52, 54, 56, 58, and 60 are shown, although persons of ordinary skill in the art will appreciate that other numbers of resistors could be used depending on the granularity desired for the trimming increments to be implemented.

Resistors 52, 54, 56, and 58 may be individually bypassed by short circuiting them. Thus, resistor 52 may be short circuited by turning on n-channel MOS transistor 62 by activating gate bias circuit 64. Similarly, resistor 54 may be short circuited by turning on n-channel MOS transistor 66 by activating gate bias circuit 68, resistor 56 may be short circuited by turning on n-channel MOS transistor 70 by activating gate bias circuit 72, and resistor 58 may be short circuited by turning on n-channel MOS transistor 74 by activating gate bias circuit 76. Resistor 60 is not associated with a bypass transistor.

Typically, the value of resistor 60 is chosen to constitute the majority of the total value of series resistance of resistors 52, 54, 56, 58, and 60, and the remaining component of the total resistance of 52, 54, 56, 58, and 60 is made up of resistors 52, 54, 56, and 58. In an exemplary embodiment, resistor 60 may constitute 90% of the total resistance and the remaining 10% of the total resistance may be equally divided among resistors 52, 54, 56, and 58. Persons skilled in the art will appreciate that other arrangements for splitting the total resistance among resistors 52, 54, 56, 58, and 60 are contemplated within the scope of the present invention.

The trimmable resistor 50 may be used in place of both resistances $R_A$, both resistances $R_B$, or resistance $R_C$. As will be appreciated by persons of ordinary skill in the art, the design of gate bias circuits 64, 68, 72, and 76 will change depending on which resistance trimmable resistor 50 is used to replace as well as on the resistance value allocation scheme employed for trimmable resistor 50. The reason for this is that the gate voltage to be applied to each of n-channel MOS transistors 52, 54, 56, and 58 will have to be positive with respect to the voltage that appears on its source. The source voltage of the n-channel MOS transistor to be turned on will, in turn, depend upon where in the voltage-divider chain trimmable resistor 50 is placed, i.e., which of resistor pairs 24 and 28, 26 and 30, or resistor 32 by itself is replaced by trimmable resistor 50, as well as on the resistance value allocation scheme employed for trimmable resistor 50. As will be appreciated by such skilled persons, the gate bias circuit will consume more die area where resistance $R_C$ of resistor 32 is to be replaced by trimmable resistor 50 since the sources of the n-channel MOS transistors will be at negative potentials and it must be assured that the gates and bulks of the n-channel MOS transistors must be biased at the lowest negative voltage to assure that they will be turned off.

While embodiments and applications of this invention have been shown and described, it would be apparent to those skilled in the art that many more modifications than mentioned above are possible without departing from the inventive concepts herein. The invention, therefore, is not to be restricted except in the spirit of the appended claims.

What is claimed is:

1. A control circuit for a negative voltage regulator including:

a stable positive voltage reference potential;

a first voltage divider including a first resistor having a first resistance and coupled to the positive voltage reference potential in series with a second resistor having a second resistance and coupled to ground;

a second voltage divider including a third resistor having the first resistance and coupled to the positive voltage reference potential in series with a fourth resistor having the second resistance, the fourth resistor in series with a fifth resistor having a third resistance and coupled to a negative voltage potential; and a comparator having an inverting input coupled to the first voltage divider between the first and second resistors and a non-inverting input coupled to the second voltage divider between the third and fourth resistors;

wherein the values of the first and third resistors are equal, the values of the second and fourth resistors are equal, and the value of the fifth resistor is chosen such that it will drop a voltage equal in magnitude to a target voltage to be regulated when the voltage regulator output is equal to that target voltage.

2. The control circuit of claim 1 wherein the stable positive voltage reference is a bandgap reference.

3. The control circuit of claim 1 wherein the fifth resistor is electronically trimmable.

4. The control circuit of claim 1 wherein the first and third resistors are both electronically trimmable.

5. The control circuit of claim 1 wherein the second and fourth resistors are both electronically trimmable.

6. The control circuit of claim 1 wherein:

the first and third resistors are both electronically trimmable; and the second and fourth resistors are both electronically trimmable.

7. A method for controlling a negative voltage regulator driven by a charge pump and having a target output voltage, the method comprising:

providing a stable positive voltage reference;

dividing the total voltage between the stable positive reference voltage and a fixed potential between a first resistor of a first resistance value in series with a second resistor having a second resistance value;

dividing the total voltage between the stable positive reference voltage and a potential at a negative voltage regulator output node between a third resistor having the first resistance value, a fourth resistor having the second resistance value, and a fifth resistor having a third resistance value chosen to drop the target output voltage across it when the potential at the negative voltage regulator output node reaches the target output voltage;

comparing the voltages at a first node between the first and second resistors and a second node between the third and fourth resistors to determine when the voltage at the second node becomes greater than the voltage at the first node; and altering the operation of the charge pump when the voltage at the second node becomes less than the voltage at the first node.

8. The method of claim 7 wherein dividing the total voltage between the stable positive reference voltage and the fixed potential between the first resistor of the first resistance value in series with the second resistor having the second resistance value comprises dividing the total voltage between the stable positive reference voltage and ground.

9. The method of claim 7 wherein altering the operation of the charge pump comprises turning the charge pump off.

10. The method of claim 7 wherein altering the operation of the charge pump comprises drawing more current from the charge pump.

11. The method of claim 10 wherein drawing more current from the charge pump comprises turning on a transistor coupled to the negative voltage regulator output node.

* * * * *